US007525512B2

(12) United States Patent
Ikura et al.

(10) Patent No.: US 7,525,512 B2
(45) Date of Patent: Apr. 28, 2009

(54) TESTING AND INSPECTING METHOD OF A PLASMA DISPLAY PANEL

(75) Inventors: Tsuneo Ikura, Ibaraki (JP); Takao Wakitani, Takatsuki (JP)

(73) Assignee: Panasonic Corporation, Osaka (JP)

( * ) Notice: Subject to any disclaimer, the term of this patent is extended or adjusted under 35 U.S.C. 154(b) by 356 days.

(21) Appl. No.: 10/542,612

(22) PCT Filed: Nov. 22, 2004

(86) PCT No.: PCT/JP2004/017668

§ 371 (c)(1),
(2), (4) Date: Jul. 18, 2005

(87) PCT Pub. No.: WO2005/052975

PCT Pub. Date: Jun. 9, 2005

(65) Prior Publication Data

US 2006/0132049 A1 Jun. 22, 2006

(30) Foreign Application Priority Data

Nov. 27, 2003 (JP) ..... 2003-396913

(51) Int. Cl.
*G09G 3/28* (2006.01)

(52) U.S. Cl. ..... 345/60; 345/37; 345/41; 345/63; 345/68; 315/169.1; 315/169.3

(58) Field of Classification Search ..... 345/60–72, 345/207, 209, 41, 42; 315/169.1
See application file for complete search history.

(56) References Cited

U.S. PATENT DOCUMENTS 5,940,142 A * 8/1999 Wakitani et al. ..... 348/671
6,414,657 B1 * 7/2002 Kasahara et al. ..... 345/63

FOREIGN PATENT DOCUMENTS

JP 10-302639 11/1998
JP 11-175022 7/1999

* cited by examiner

*Primary Examiner*—Richard Hjerpe
*Assistant Examiner*—Jennifer T Nguyen
(74) *Attorney, Agent, or Firm*—Wenderoth, Lind & Ponack, L.L.P.

(57) ABSTRACT

An improved method of testing and inspecting a plasma display panel. In a plasma display panel, a plurality of cells are formed at an intersection of each electrode disposed in a row direction and in a column direction of the panel. A field is formed of a plurality of sub-fields, and the combination of the sub-fields enables the panel to have a gradation display. In the inspection method, an address pulse voltage is not applied to a target cell to be inspected in a predetermined sub-field, but is applied to at least one cell of the cells adjacent to the target cell, and the address pulse voltage is applied to the target cell in the successive sub-field. If the barrier ribs of the target cell have an imperfection, wall charges of the cell are affected by the discharge occurred in an adjacent cell, and the target cell fails to light on in the successive sub-field. The inspection method can thus detect lighting failure caused by defective barrier ribs.

5 Claims, 7 Drawing Sheets

R-cell

| rows | 1SF | 2SF | 3SF | 4SF | 5SF | 6SF | 7SF | 8SF |
|---|---|---|---|---|---|---|---|---|
| odd-rows | O | O | O | × | × | × | × | × |
| even-rows | × | × | × | × | × | × | × | × |

G-cell

| rows | 1SF | 2SF | 3SF | 4SF | 5SF | 6SF | 7SF | 8SF |
|---|---|---|---|---|---|---|---|---|
| odd-rows | × | × | × | O | × | × | × | × |
| even-rows | × | × | × | × | × | × | × | × |

B-cell

| rows | 1SF | 2SF | 3SF | 4SF | 5SF | 6SF | 7SF | 8SF |
|---|---|---|---|---|---|---|---|---|
| odd-rows | O | O | O | × | × | × | × | × |
| even-rows | × | × | × | × | × | × | × | × |

O : address pulse is applied
× : address pulse is not applied

FIG. 6

R-cell

| rows | 1SF | 2SF | 3SF | 4SF | 5SF | 6SF | 7SF | 8SF |
|---|---|---|---|---|---|---|---|---|
| odd-rows | O | O | O | × | × | × | × | × |
| even-rows | × | × | × | × | × | × | × | × |

G-cell

| rows | 1SF | 2SF | 3SF | 4SF | 5SF | 6SF | 7SF | 8SF |
|---|---|---|---|---|---|---|---|---|
| odd-rows | × | × | × | O | × | × | × | × |
| even-rows | × | × | × | × | × | × | × | × |

B-cell

| rows | 1SF | 2SF | 3SF | 4SF | 5SF | 6SF | 7SF | 8SF |
|---|---|---|---|---|---|---|---|---|
| odd-rows | O | O | O | × | × | × | × | × |
| even-rows | × | × | × | × | × | × | × | × |

O : address pulse is applied
× : address pulse is not applied

FIG. 7

R-cell

| rows | 1SF | 2SF | 3SF | 4SF | 5SF | 6SF | 7SF | 8SF |
|---|---|---|---|---|---|---|---|---|
| odd-rows | × | × | × | × | × | × | × | × |
| even-rows | × | × | × | × | × | × | × | × |

G-cell

| rows | 1SF | 2SF | 3SF | 4SF | 5SF | 6SF | 7SF | 8SF |
|---|---|---|---|---|---|---|---|---|
| odd-rows | ○ | ○ | ○ | × | × | × | × | × |
| even-rows | × | × | × | ○ | × | × | × | × |

B-cell

| rows | 1SF | 2SF | 3SF | 4SF | 5SF | 6SF | 7SF | 8SF |
|---|---|---|---|---|---|---|---|---|
| odd-rows | × | × | × | × | × | × | × | × |
| even-rows | × | × | × | × | × | × | × | × |

○ : address pulse is applied
× : address pulse is not applied

FIG. 8

R-cell

| rows | 1SF | 2SF | 3SF | 4SF | 5SF | 6SF | 7SF | 8SF |
|---|---|---|---|---|---|---|---|---|
| odd-rows | ○ | ○ | ○ | × | × | × | × | × |
| even-rows | × | × | × | × | × | × | × | × |

G-cell

| rows | 1SF | 2SF | 3SF | 4SF | 5SF | 6SF | 7SF | 8SF |
|---|---|---|---|---|---|---|---|---|
| odd-rows | × | × | × | × | × | × | × | × |
| even-rows | × | × | × | ○ | × | × | × | × |

B-cell

| rows | 1SF | 2SF | 3SF | 4SF | 5SF | 6SF | 7SF | 8SF |
|---|---|---|---|---|---|---|---|---|
| odd-rows | ○ | ○ | ○ | × | × | × | × | × |
| even-rows | × | × | × | × | × | × | × | × |

○ : address pulse is applied
× : address pulse is not applied

TESTING AND INSPECTING METHOD OF A PLASMA DISPLAY PANEL

TECHNICAL FIELD

The present invention relates to a method of performing lighting inspection on a plasma display panel, where the cells of the panel are lit on prior to mounting a driving circuit on the panel.

BACKGROUND ART

A plasma display panel (hereinafter referred to as a PDP) has recently been drawing attention as a flat-type display device having a low profile, and a large screen. The dominating structure of PDPs is the AC type 3-electrode surface discharge PDP. The AC-type PDP contains a front substrate on which a plurality of pairs of scan electrodes and sustain electrodes is disposed in a row direction of the PDP, and a back substrate on which a plurality of address electrodes is disposed in a column direction. The front substrate and the back substrate are oppositely located so as to form discharge space therebetween. At each intersection of an address electrode and a pair of scan electrode and a sustain electrode, a discharge cell divided by barrier ribs is formed.

In the typical PDP operation, one field of image signals is divided into sub-fields each of which has a luminance weight—known as a sub-field method. In the method, gray levels of image signals are determined by a combination of the sub-fields. Each sub-field has an initializing period where the initial discharge is produced to generate predetermined wall charges; an address period where the address discharge is produced to select discharge cells to be turned on; and a sustain period where the sustain discharge is produced at the cell selected in the address period. Through light emission caused by the sustain discharge, images are shown on the screen.

Japanese Patent Unexamined Publication No. 2000-242224, for example, introduces a PDP driving method that provides improved contrast ratio by considerably decreasing the light emission in the initial discharge.

However, conventional manufacturing has sometimes produced a PDP with quality deficiencies, for example, the application of address pulse voltage to a cell fails to invite the address discharge, or in another case, the address discharge fails to trigger the successive sustain discharge. In the manufacturing processes, a PDP undergoes the light inspection prior to mounting driving circuits thereon; nevertheless, the conventional inspection method has sometimes failed to detect PDPs having the aforementioned problems.

The present invention addresses the pending problems. It is therefore the object to provide a method of detecting a PDP containing a defective discharge cell in which the sustain discharge does not occur in a proper sub-field.

DISCLOSURE OF THE INVENTION

To achieve the object above, the lighting inspection method of the present invention is applied to a plasma display panel having a following structure—a plurality of discharge cells are formed at the intersection of each electrode disposed in a row direction and in a column direction of the panel, a field is formed of sub-fields each of which has an initializing period for producing the initial discharge, an address period for producing the address discharge with the application of address pulse voltage, and a discharge sustain period for producing sustain discharge to light on a cell, and the combination of the sub-fields enables the panel to have gradation display. In the method of the invention, the address pulse voltage is not applied to a target cell to be inspected in a predetermined sub-field, but applied to at least one cell of the cells adjacent to the target cell, and the address pulse voltage is applied to the target cell in the successive sub-field.

BRIEF DESCRIPTION OF THE DRAWINGS

FIG. 6 shows the address patterns applied to the sub-fields of a first exemplary embodiment of the present invention.

FIG. 7 shows the address patterns applied to the sub-fields of a second exemplary embodiment.

FIG. 8 shows the address patterns applied to the sub-fields of a third exemplary embodiment.

DETAILED DESCRIPTION OF CARRYING OUT OF THE INVENTION

The exemplary embodiments of the present invention are described hereinafter with reference to the accompanying drawings.

FIRST EXEMPLARY EMBODIMENT

Figure 1A:
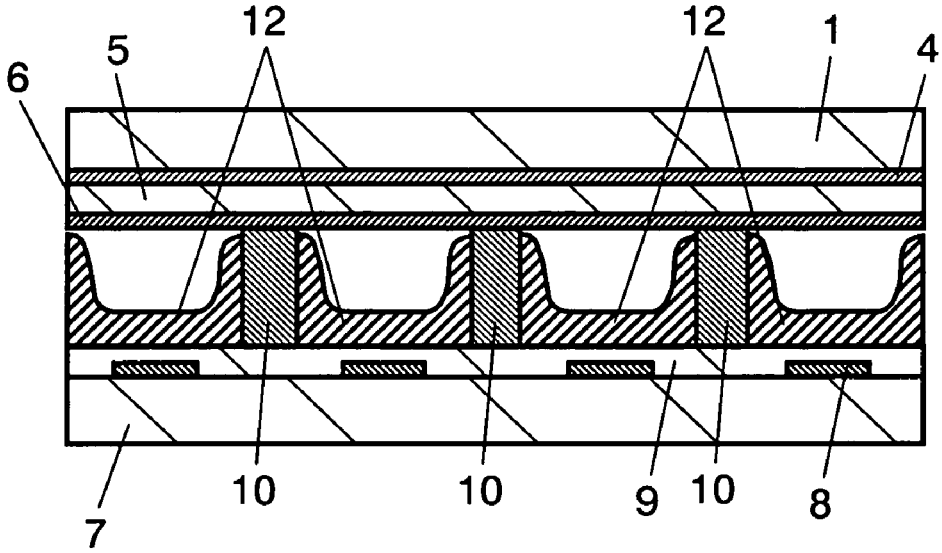
FIG. 1 is a section view illustrating the cell structure of a PDP of an embodiment of the present invention.
Figure 1B:
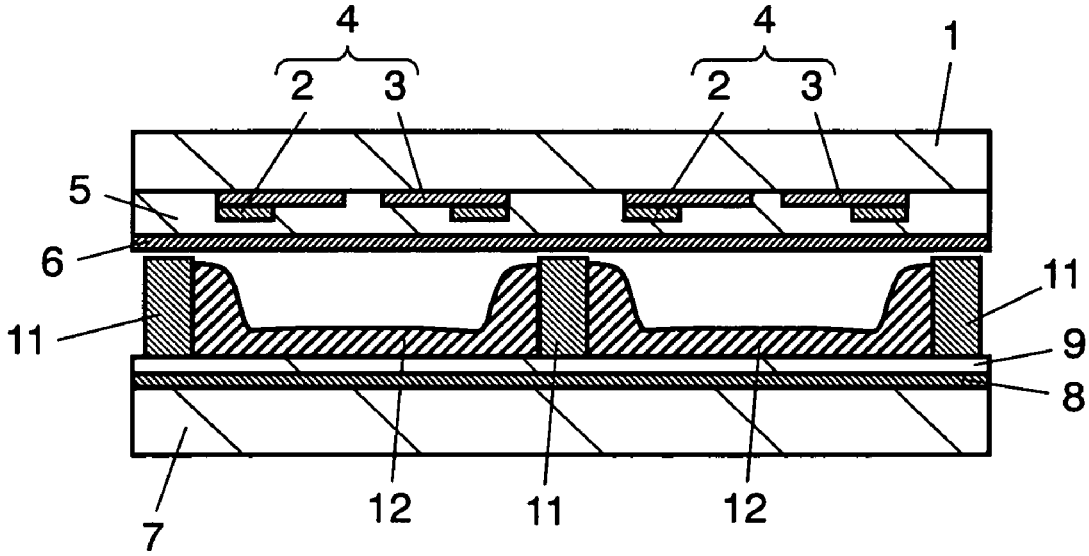

Here will be described the structure of a PDP of the first exemplary embodiment of the present invention. FIG. 1 is a section view of the PDP of the first exemplary embodiment, illustrating the section taken along the row direction (FIG. 1A), and the section taken along the column direction (FIG. 1B) of the PDP. On front substrate 1, a plurality of display electrodes 4, each of which is a pair of scan electrode 2 and sustain electrode 3 located in stripes, is disposed in parallel with each other in a row direction. Display electrodes 4 are covered with dielectric layer 5, and further on dielectric layer 5, protective layer 6 is formed. On back substrate 7 facing front substrate 1, a plurality of address electrodes 8, which is arranged also in stripes, is disposed in parallel with each other in a column direction. Dielectric layer 9 covers address electrodes 8. Column barrier-ribs 10 are formed on dielectric layer 9 so as to dispose between, and in parallel with address electrodes 8; similarly, row barrier-ribs 11 are formed on dielectric layer 9 so as to dispose between, and in parallel with display electrodes 4. Each space surrounded by column barrier-ribs 10 and row barrier-ribs 11 has phosphor layers 12 that emit color red (R), color green (G), and color blue (B). A cell, which is the minimum unit of display, is formed at the intersection of display electrodes 4 disposed in a row direction and address electrodes 8 disposed in a column direction. Performing gas discharge in each cell generates ultraviolet light, which excites phosphor layers 12, so that the images are shown on the panel.

Figure 2:
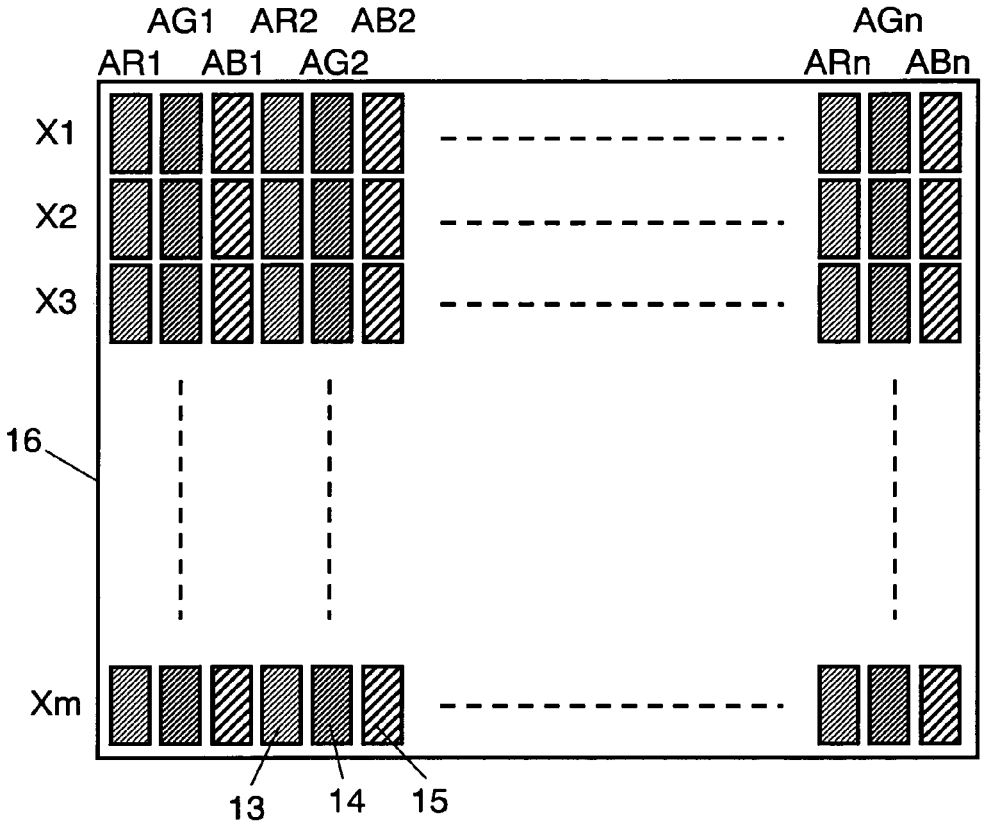
FIG. 2 schematically shows the cell lay-out of the PDP.

FIG. 2 schematically shows the cell layout of a PDP. A pixel is formed of cell 13 having a phosphor layer of red (hereinafter referred to as a R-cell), cell 14 having a phosphor layer of green (hereinafter, a G-cell), and cell 15 having a phosphor layer of blue (hereinafter, a B-cell). A PDP contains m×n pixels on the panel. In FIG. 2, X1 through Xm represent layout numbers for the cells located in 1-m rows. AR1 through ARn show R-cell 13 located in 1-n columns, similarly, AG1 through AGn are given to G-cell 14 located in 1-n columns, and AB1 through ABn are for B-cell 15 located in 1-n columns.

Figure 3:
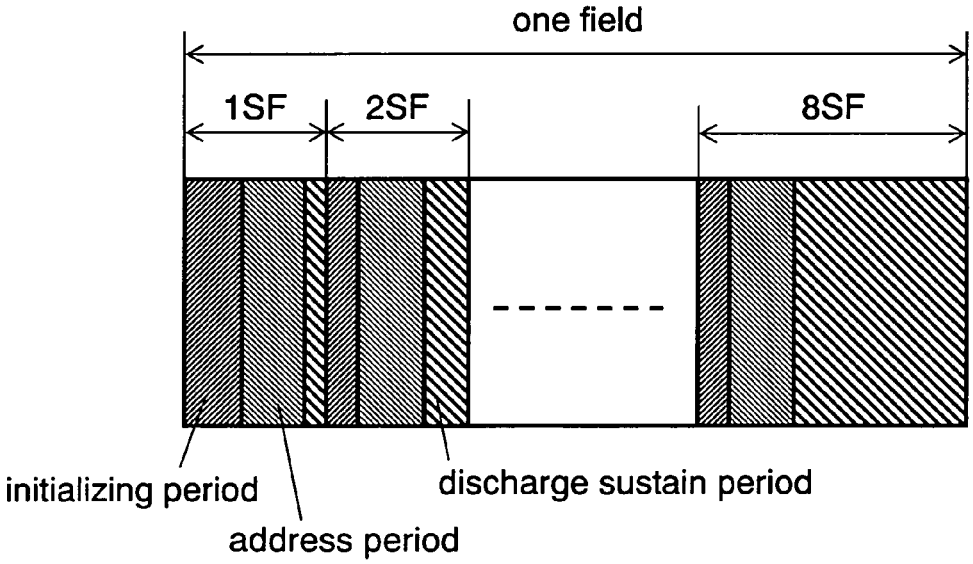
FIG. 3 shows the structure of sub-fields for driving the PDP.

FIG. 3 shows the structure of a sub-field of the first embodiment. In a PDP, one field is divided into a plurality of sub-fields. Combining the sub-fields to light on cells enables the PDP to provide gradation display. A field is formed of, for example, eight sub-fields of 1SF through 8SF. Each sub-field has an initializing period, an address period, and a discharge sustain period. The discharge sustain period of each sub-field has a weight according to the luminance of each sub-field. When the sub-fields 1SF through 8SF have weights, for example, with the ratio of 1:2:4:8:16:32:64:128, the combination of the sub-fields to light on cells enables the PDP to provide 256-level gray scale.

Figure 4:
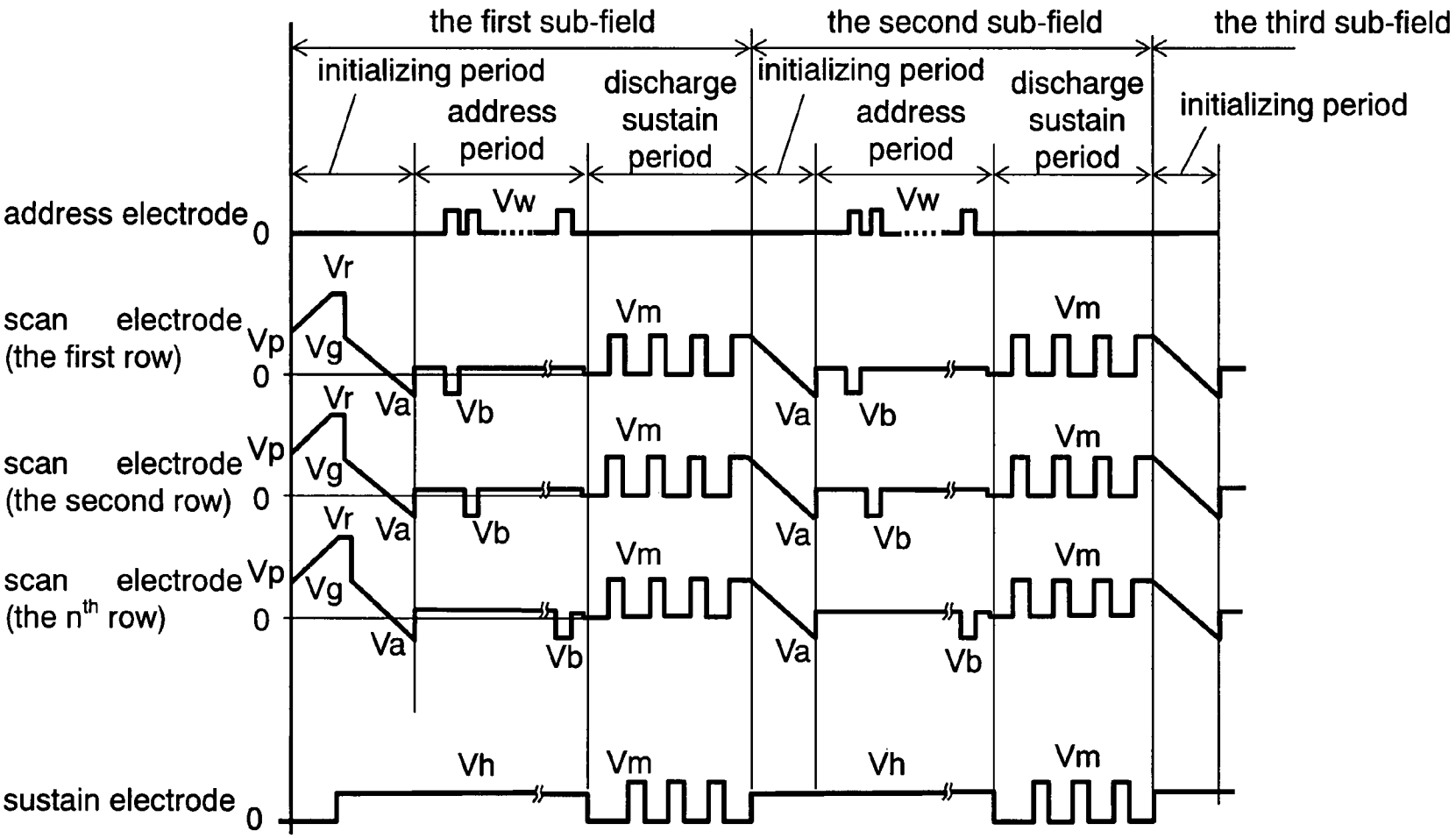
FIG. 4 shows driving waveforms applied to the PDP in driving operation.

FIG. 4 shows driving waveforms applied to the PDP in driving operation of the embodiment. In the initializing period of the first sub-field, maintain all of the address electrodes and the sustain electrodes at zero volt (V), on the other hand, apply a voltage with a ramp—starting from voltage Vp (V) lower than the discharge starting voltage and then increasing with a gentle rise to Vr (V) that exceeds the discharge starting voltage—to all of the scan electrodes. With the application of voltage above, all the cells experience an extremely weak discharge, by which the sustain electrodes and address electrodes carry positive wall charges, whereas scan electrodes carries negative wall charges. After that, maintain all of the sustain electrodes at positive voltage Vh (V), on the other hand, apply a ramp voltage—starting from Vg (V) and gently decreasing to Va (V)—to all of the scan electrodes. The application of voltage causes another extremely weak discharge in all the cells. The discharge weakens the wall charges collected on each electrode. The initial discharge produced above approximates the voltage in a cell to the discharge starting voltage.

In the address period of the first sub-field, apply scan pulse voltage Vb (V) to the scan electrodes sequentially from the first row, and at the same time, apply address pulse voltage Vw (V) to a desired address electrode according to an image signal. The application of voltage above produces address discharge at a cell to be lit on, thereby forming wall charges in the cell according to the image signal.

In the discharge sustain period of the first sub-field, apply sustain pulse voltage Vm (V) alternately to all of the scan electrodes and sustain electrodes. The application of voltage above produces sustain discharge in the cells that underwent the address discharge, and lights on the cells. In this way, light emission brought by the sustain discharge appears on the panel as images.

At the start of the initializing period of the second sub-field, the cells that underwent sustain discharge in the first sub-field retain positive wall charges on the sustain electrodes and the address electrodes, and retain negative wall charges on the scan electrodes. In the initializing period of the second sub-field, maintain all of the sustain electrodes at Vh (V), and maintain all of the address electrodes at zero (V). On the other hand, apply a ramp voltage—starting from Vm (V) and gently decreasing to Va (V)—to all of the scan electrodes. During the decrease of the ramp voltage, in the cells that experienced sustain discharge in the previous sub-field (i.e., the first sub-field), an extremely weak discharge occurs. The discharge weakens the wall charges formed on each electrode, thereby approximating the voltage of the cells to the discharge starting voltage. On the other hand, the cells, where neither address discharge nor sustain discharge occurred, has no weak discharge in the initializing period of the second sub-field. Therefore, the cells retain the wall charges the same as those retained at the end of the initializing period of the first sub-field.

In the address period and the discharge sustain period of the second sub-field, apply voltage having waveforms the same as those used in the first sub-field to each electrode to produce sustain discharge in the cells according to the image signal. In this way, in the third sub-field through eighth sub-field, each electrode experiences the application of voltage having the same driving waveform as those employed in the second sub-field, so that the image according to the image signals is shown on the panel.

As described above, the first sub-field experiences complete initializing operation in which initializing discharge occurs in all the cells, while the second through the eighth sub-fields experience selective initializing operation in which the initializing discharge occurs only in the cells that experienced sustain discharge in the previous sub-field. As a result, the complete initializing operation in the first sub-field, which has no contribution to light emission for display, produces an extremely weak emission brought by the ramp voltage, whereas the selective initializing operation in the second through the eighth sub-fields, enable image display to have sharp contrast.

However, if a part of the barrier ribs has minute imperfections including protuberances and hollows, such defects can invite a discharge failure. For example, in a sub-field that does not select the cell containing the defective part of the barrier ribs but selects the cell adjacent to the defective cell, wall charges of the defective cell can be decreased under the influence of the discharge occurred in the neighbor cell. In this case, if address pulse voltage is applied to the defective cell in the successive sub-field, the address discharge does not occur, or even if it does occur, the address discharge does not lead to the sustain discharge due to the lack of the wall charges.

Figure 5:
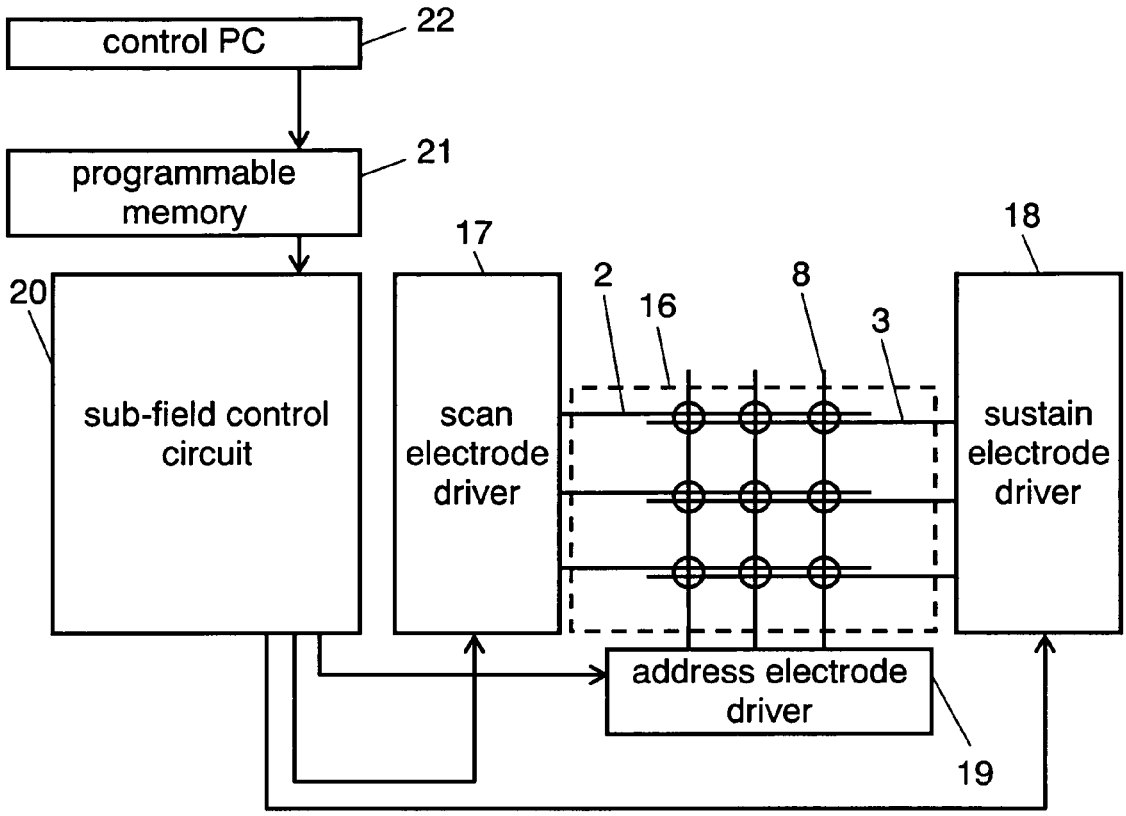
FIG. 5 is a circuit diagram of a lighting inspection device for the PDP.

FIG. 5 shows a circuit block diagram of a light inspection device of the first embodiment, which detects a PDP having the problems above. The light inspection device contains scan electrode driver 17 for driving scan electrodes 2 of PDP 16; sustain electrode driver 18 for driving sustain electrodes 3; address electrode driver 19 for driving address electrodes 8; sub-field control circuit 20; programmable memory 21; and control PC 22. Control PC 22 generates address pattern (will be described later) of sub-fields. The address pattern is sent to programmable memory 21 and stored there. Sub-field control circuit 20 reads out the address pattern from programmable memory 21, and according to the pattern, scan electrode driver 17, sustain electrode driver 18, and address electrode driver 19 drive respective electrodes of PDP 16.

Next will be described how the light inspection device performs light inspection on PDP 16. The driving waveforms to be applied to each electrode of PDP 16 in the inspection are the same as those shown in FIG. 4. FIG. 6 shows the address pattern assigned to the sub-fields when PDP 16 undergoes the light inspection. The address pattern shows which cell undergoes the address pulse voltage for producing address discharge in each address period of the sub-fields. According to the patterns shown in FIG. 6, in the first sub-field (1SF) through third sub-field (3SF), both the R-cells and the B-cells located in the rows having odd numbers continuously undergo address pulse voltage, and in 4SF through 8SF, these cells have no application of the voltage. The G-cells located in the odd-rows undergo the application of the voltage only in 4SF; in the rest of the sub-fields i.e., 1SF-3SF, and 5SF-8SF, the G-cells have no application of voltage. On the other hand, all of the cells located in the even-rows have no address pulse voltage during one field.

If a part of column barrier-ribs 10 or row barrier-ribs 11 of a G-cell located in an odd-row have minute imperfections including protuberances and hollows, the wall charges of the G-cell tend to be susceptive to the discharge occurred in the R-cell and B-cell adjacent to the G-cell. To be more specific, charged particles of the R-cell and B-cell generated in 1SF through 3SF sometimes move into the G-cell through the defective part of the barrier ribs, thereby decreasing the number of the wall charges of the G-cell. Since a G-cell at an odd-row stays turned off during 1SF through 3SF, the G-cell has no initializing discharge in the initializing period of 4SF where the selective initializing operation takes place. Even with the application of address pulse voltage in the successive address period, wall charges are not sufficiently formed in the G-cell, and due to the lack of wall charges, the G-cell has no sustain discharge in the following discharge sustain period. As a result, the G-cell fails to light on. The lighting inspection using the address patterns shown in FIG. 6 can detect whether or not the G-cells located in odd-rows as a target cell are affected by the influence of the discharge that occurred in the cells adjacent to the target cell in a row direction.

In the next field, the odd-row patterns and the even-row patterns of the address patterns are exchanged with each other. That is, all of the cells at odd-rows have no application of address pulse voltage during one field. The R-cells and B-cells at even-rows continuously experience the application of address pulse voltage for 1SF through 3SF, and have no application of voltage for 5SF through 8SF. The G-cells at even-rows experiences the application of address pulse voltage in 4SF only; the rest of the fields, i.e., in 1SF-3SF, and 5SF-8SF, there is no application to the G-cells. With the use of the address patterns, the lighting inspection can detect whether or not the G-cells at even-rows as a target cell are affected by the influence of the discharge that occurred in the cells adjacent to the target cell in a row direction.

Furthermore, in another field, the R-cells (each for at odd-rows and even-rows) can be tested as a target cell by exchanging the address pattern of the R-cells with that of the G-cells; similarly, the B-cells (each for at odd-rows and even-rows) can be tested as a target cell by exchanging the address pattern of the B-cells with that of the G-cells. In this way, the lighting inspection can test whether or not a target cell is affected by the influence of the discharge that occurred in the cells adjacent to the target cell in a row direction.

The lighting inspection, as described above, can detect a defective cell that fails to light on, that is, can detect a PDP that contains a cell with display failure affected by the discharge of the neighbor cells in a row direction. In this way, improvement in accuracy of light inspection can prevent a faulty panel from being carried to subsequent processes in manufacturing, thereby considerably reducing losses in manufacturing cost.

SECOND EXEMPLARY EMBODIMENT

Here will be described a PDP lighting inspection method of the second embodiment of the present invention. The method of the second embodiment differs from that of the first embodiment in the address pattern used in the lighting inspection of PDP 16.

FIG. 7 shows the address pattern assigned to the sub-fields when PDP 16 undergoes the light inspection of the embodiment. According to the pattern shown in FIG. 7, all of the R-cells and B-cells have no application of address pulse voltage during one field. The G-cells at odd-rows continuously undergo the application of address pulse voltage in 1SF through 3SF, but in successive 4SF through 8SF, the cells have no application of voltage. On the other hand, the G-cells at even-rows undergo the application of the voltage only in 4SF, but in the rest of the sub-fields, i.e., 1SF-3SF, and 5SF-8SF, the cells have no application of voltage.

In the lighting inspection above, if a part of column barrier-ribs 10 or row barrier-ribs 11 of a G-cell located in an even-row have minute imperfections including protuberances and hollows, the wall charges of the G-cell tend to be susceptive to the discharge occurred in a G-cell adjacent to the defective G-cell, thereby decreasing the wall charges in number. Since G-cells at even-rows stay turned off during 1SF through 3SF, the defective G-cell has no initializing discharge in the initializing period of 4SF where the selective initializing operation takes place. Even with the application of address pulse voltage in the successive address period, wall charges are not sufficiently formed in the G-cell, and due to the lack of wall charges, the G-cell has no sustain discharge in the following discharge sustain period. As a result, the G-cell fails to light on. The lighting inspection using the address patterns shown in FIG. 7 can detect whether or not the G-cells located in even-rows as a target cell are affected by the influence of the discharge that occurred in the cells adjacent to the target cell in a column direction.

In the next field, the odd-row patterns and the even-row patterns of the address patterns of FIG. 7 are exchanged with each other. That is, all of the R-cells and B-cells have no application of address pulse voltage during one field. The G-cells at even-rows continuously experience the application of address pulse voltage for 1SF through 3SF, and have no application of voltage for 4SF through 8SF. The G-cells at odd-rows experiences the application of address pulse voltage in 4SF only; the rest of the fields, i.e., in 1SF-3SF, and 5SF-8SF, there is no application to the G-cells. With the use of the address patterns, the lighting inspection can detect whether or not the G-cells at odd-rows as a target cell are affected by the influence of the discharge that occurred in the cells adjacent to the target cell in a column direction.

Furthermore, in another field, the R-cells (each for at odd-rows and even-rows) can be tested as a target cell by exchanging the address pattern of the R-cells with that of the G-cells; similarly, the B-cells (each for at odd-rows and even-rows) can be tested as a target cell by exchanging the address pattern of the B-cells with that of the G-cells. In this way, the lighting inspection can test whether or not a target cell is affected by the influence of the discharge that occurred in the cells adjacent to the target cell in a column direction.

The lighting inspection, as described above, can detect a defective cell that fails to light on, that is, can detect a PDP that contains a cell with display failure affected by the discharge that occurred in the cells adjacent to the target cell in a column direction. In this way, improvement in accuracy of light inspection can prevent a faulty panel from being carried to subsequent processes in manufacturing, thereby considerably reducing losses in manufacturing cost.

THIRD EXEMPLARY EMBODIMENT

Next will be described a PDP lighting inspection method of the third embodiment of the present invention. The method of the third embodiment differs from those of the first and second embodiments in the address pattern used in the lighting inspection of PDP 16, and the rest of the structure is the same as those of the first and second embodiments.

FIG. 8 shows the address pattern assigned to the sub-fields when PDP 16 undergoes the light inspection of the embodiment. According to the pattern shown in FIG. 8, the R-cells and B-cells at even-rows and the G-cells at odd-rows have no application of address pulse voltage during one field. The R-cells and B-cells at odd-rows continuously undergo the application of address pulse voltage in 1SF through 3SF, but in successive 4SF through 8SF, the cells have no application of voltage. On the other hand, the G-cells at even-rows undergo the application of the voltage only in 4SF, and in the rest of the sub-fields, i.e., 1SF-3SF, and 5SF-8SF, the cells have no application of voltage.

In the lighting inspection above, if a part of column barrier-ribs 10 or row barrier-ribs 11 of a G-cell located in an even-row have minute imperfections including protuberances and hollows, the wall charges of the G-cell can be reduced under the influence of the discharge occurred in an R-cell or B-cell diagonally adjacent to the defective G-cell. In such a G-cell having poor wall charges, in spite of application of address pulse voltage in the successive address period, wall charges are not sufficiently formed, and due to the lack of wall charges, the G-cell has no sustain discharge in the following discharge sustain period. As a result, the G-cell fails to light on. The lighting inspection using the address patterns shown in FIG. 8 can detect whether or not the G-cells located in even-rows as a target cell are affected by the influence of the discharge that occurred in the cells adjacent to the target cell in a diagonal direction.

In the next field, the odd-row patterns and the even-row patterns of the address patterns of FIG. 8 are exchanged with each other. Furthermore, in another field, the R-cells (each for at odd-rows and even-rows) can be tested as a target cell by exchanging the address pattern of the R-cells with that of the G-cells; similarly, the B-cells (each for at odd-rows and even-rows) can be tested as a target cell by exchanging the address pattern of the B-cells with that of the G-cells. In this way, the lighting inspection can test whether or not a target cell is affected by the influence of the discharge that occurred in the cells adjacent to the target cell in a diagonal direction.

The lighting inspection, as described above, can detect a defective cell that fails to light on, that is, can detect a PDP that contains a cell with display failure affected by the discharge that occurred in the cells adjacent to the target cell in a diagonal direction.

The presence or absence of cells that failed to light on can also be tested by an image recognition system employing a CCD camera. In this case, the inspection period is determined to be one field for each address pattern including the patterns in which the even-rows and the odd-rows are exchanged, and in which the R-cells, G-cells, and B-cells are exchanged. In the methods of the first through third embodiments, employing the aforementioned system can contributes to shortened inspection time. The presence or the absence of defective cells may be checked by visual inspection. In this case, performing the visual inspection in a manner to continue each pattern for several fields may be a great help in judging proper operation.

As is the address pattern used in the embodiments, the cells adjacent to a target cell are lit on for 1SF-3SF, whereas the target cell is lit on for 4SF only. The lighting inspection can be done in such a way that the adjacent cells are also lit on for 4SF-8SF; however, when the adjacent cells are set to turn on for at least one of 4SF through 8SF, the setting sometimes makes difficult to judge whether or not the target cell turns on at 4SF. From the reason, as is described in each embodiment above, the adjacent cells should preferably be turned off for 4SF-8SF.

Although the cell to be tested undergoes the application of address pulse voltage in 4SF, not in 1SF through 3SF, it is not limited thereto. The timing of the application of voltage can be flexibly defined at a sub-field where the selective initializing operation takes place according to panel characteristics. For example, address pulse voltage may be applied to a cell in 6SF, not in 1SF-5SF.

Although the description above introduces the method of inspecting influence of adjacent cells in three directions on a target cell: the influence in a row direction described in the first embodiment; the influence in a column direction described in the second embodiment; and the influence in a diagonal direction described in the third embodiment, it is not limited thereto. The address pattern can be defined so as to inspect the influence of discharging occurred in the adjacent cells in at least two directions above. Furthermore, the influence brought by a cell of the cells adjacent to the target cell can be detected. That is, the address pulse voltage is not applied to a target cell in a predetermined sub-field, but applied to at least one certain cell of the cells adjacent to the target cell; and then the address pulse voltage is applied to the target cell in the next sub-field.

Although the description in the embodiments above is given on the method of inspecting PDPs having column barrier-rib 10 and row barrier-rib 11, the method of the present invention can be applied to a PDP without row barrier-rib 11.

The lighting inspection method of the present invention, as described above, can effectively detect a PDP having a defective cell in which the sustain discharge fails in a proper sub-field.

INDUSTRIAL APPLICABILITY

The lighting inspection method of the present invention, as described above, can effectively detect a PDP having a defective cell in which the sustain discharge fails in a proper sub-field. The present invention provides the useful method of performing lighting inspection on a PDP in which the cells of the panel are lit on prior to mounting a driving circuit thereon.

The invention claimed is:

1. A method of testing and inspecting a plasma display panel in which a plurality of cells are formed at an intersection of each electrode disposed in a row direction and in a column direction, comprising:

forming a field from a plurality of sub-fields, each subfield having an initializing period for producing an initial discharge, an address period for producing an address discharge with application of an address pulse voltage, and a discharge sustain period for producing a sustain discharge, and obtaining a gradation display using a combination of the plurality of sub-fields that are responsible for turning on the plurality of cells, wherein, the address pulse voltage is not applied to a target cell in a predetermined sub-field to be tested and inspected, but is applied to at least one specific cell of adjacent cells positioned adjacent to the target cell, and the address pulse voltage is applied to the target cell in a successive sub-field, and it is judged whether the target cell in the successive sub-field is on or not.

2. The method of testing and inspecting a plasma display panel of claim 1, wherein the specific cell is adjacent to the target cell in a row direction.

3. The method of testing and inspecting a plasma display panel of claim 1, wherein the specific cell is adjacent to the target cell in a column direction.

4. The method of testing and inspecting a plasma display panel of claim 1, wherein the specific cell is adjacent to the target cell in a diagonal direction.

5. The method of testing and inspecting a plasma display panel of claim 1, wherein the specific cell is adjacent to the target cell in at least two of a row direction, a column direction, and a diagonal direction.

* * * * *